US005220341A

United States Patent [19]

Yamazaki

[11] Patent Number: 5,220,341

[45] Date of Patent: Jun. 15, 1993

[54] TELESCOPING ANTENNA APPARATUS WITH LEAKAGE PREVENTION BETWEEN ITS UPPER AND LOWER SECTIONS

[75] Inventor: Toru Yamazaki, Chita, Japan

[73] Assignee: Nippondenso Co., Ltd., Kariya, Japan

[21] Appl. No.: 600,689

[22] Filed: Oct. 22, 1990

[30] Foreign Application Priority Data

Nov. 1, 1989 [JP] Japan ..... 1-285370

[51] Int. Cl.[5] ..... H01Q 1/10

[52] U.S. Cl. ..... 343/901; 343/903; 343/715

[58] Field of Search ..... 343/900, 901, 903, 715, 343/790

[56] References Cited

U.S. PATENT DOCUMENTS

| | | | |
|---|---|---|---|
| 3,576,578 | 4/1971 | Harper | 343/791 |
| 4,496,953 | 1/1985 | Spinks, Jr. et al. | 343/792 |
| 4,527,168 | 7/1985 | Edwards | 343/901 |
| 4,658,260 | 4/1987 | Myer | 343/792 |
| 4,725,846 | 2/1988 | Hendershot | 343/792 |
| 4,734,703 | 3/1988 | Nakase et al. | 343/790 |
| 4,847,629 | 7/1989 | Shimazaki | 343/901 |
| 4,864,322 | 9/1989 | Yamamoto et al. | 343/903 |
| 4,958,382 | 9/1990 | Imanishi | 343/702 |
| 4,968,991 | 11/1990 | Yamazaki | 343/901 |
| 5,072,230 | 12/1991 | Taniyoshi et al. | 343/722 |

FOREIGN PATENT DOCUMENTS

| | | | |
|---|---|---|---|
| 1161644 | 9/1958 | France | 343/901 |
| 495062 | 7/1954 | Italy | 343/901 |
| 59-97207 | 6/1984 | Japan . | |
| 60-249403 | 12/1985 | Japan . | |
| 64-78004 | 3/1989 | Japan . | |
| 8700351 | 1/1987 | PCT Int'l Appl. . | |
| 2141878 | 1/1985 | United Kingdom . | |
| 2185634 | 7/1987 | United Kingdom . | |
| 2185635 | 7/1987 | United Kingdom . | |
| 2219911 | 12/1989 | United Kingdom . | |

*Primary Examiner*—Rolf Hille
*Assistant Examiner*—Hoanganh Le
*Attorney, Agent, or Firm*—Cushman, Darby & Cushman

[57] ABSTRACT

An telescoping antenna includes a lower antenna portion and an upper antenna portion to be telescoped into the lower antenna portion. The lower antenna portion includes a cylindrical conductor having an inner cavity for accommodating the upper antenna portion and a coaxial feeder cable. A cylindrical member, which is electrically connected to the cylindrical conductor and the coaxial feeder cable, is provided in the cavity so that a first leakage current is prevented from flowing into the coaxial feeder cable from the cylindrical conductor and that a second leakage current is prevented from flowing into the lower antenna portion from the upper antenna portion.

11 Claims, 6 Drawing Sheets

TELESCOPING ANTENNA APPARATUS WITH LEAKAGE PREVENTION BETWEEN ITS UPPER AND LOWER SECTIONS

BACKGROUND OF THE INVENTION

1. Field of the Invention

This invention relates to an integrated telescoping antenna apparatus wherein a plurality of antenna portions individually acting as different antennas are disposed coaxially and which is used as a shared antenna for transmitting or receiving radio waves of different frequency bands simultaneously or as a diversity antenna for obtaining a diversity effect.

2. Description of the Related Art

A diversity antenna is conventionally known wherein two sleeve antenna portions are disposed at upper and lower stages in a vertical column as disclosed, for example, in Japanese Patent Laid-Open No. 97207/1984. The conventional diversity antenna is constituted such that, in order to prevent a coaxial feeder cable connected to the upper antenna portion and leakage current from having an influence on an impedance characteristic of the lower antenna portion, the coaxial feeder cable for the upper antenna portion extends through the inside of the lower antenna portion and a radio wave absorbing member or a current limiting metal member is mounted between the upper and lower antenna portions. Where such radio wave absorbing member or current limiting metal member is mounted between the upper and lower antenna portions, the two sleeve antenna portions individually function as independent antennas without any deterioration in sensitivity thereof.

With the conventional diversity antenna, however, while leakage current flowing from the upper antenna portion to an outer conductor of the coaxial feeder cable can be cut off, current may possibly leak from an upper end of the lower antenna portion to the outer conductor of the coaxial feeder cable extending through the inside of the lower antenna portion because the radio wave absorbing member or current limiting metal member is mounted in a slightly spaced relationship from both of the upper and lower antenna portions between the upper and lower antenna portions. Here, if current leaks from the lower antenna portion to the outer conductor of the coaxial feeder cable, the impedance characteristic of the lower antenna portion is varied so that the sensitivity thereof is deteriorated. It is to be noted that to prevent leakage current in the present invention signifies to block leakage current which may have a bad influence on the antenna sensitivity.

SUMMARY OF THE INVENTION

In order to solve the problem of the conventional antenna apparatus, it is an object of the present invention to provide an antenna apparatus wherein a plurality of antenna portions individually acting as different antennae are arranged coaxially, which is improved in sensitivity thereof by cutting off leakage current from an upper end of the lower antenna portion to a coaxial feeder cable extending through the inside of the lower antenna portion.

It is another object of the present invention to provide an antenna apparatus wherein an upper antenna portion can be accommodated in a lower antenna portion and current which may leak from an upper end of the lower antenna portion to a coaxial feeder cable can be prevented while also leakage current from the upper antenna portion can be prevented.

It is a further object of the present invention to provide an antenna apparatus wherein the overall length thereof when an upper antenna portion is extended upwardly from a lower antenna portion can be limited while achieving the effects described above.

It is a still further object of the present invention to provide an antenna apparatus of a high sensitivity wherein an accommodation space at least when an upper antenna portion is accommodated in a lower antenna portion is small.

It is a yet further object of the present invention to provide an antenna apparatus wherein a leakage current limiting member serves also as a member for preventing an upper antenna portion from coming off from a lower antenna portion when the upper antenna portion is extended upwardly from the lower antenna portion.

It is an additional object of the present invention to provide an antenna apparatus wherein a leakage current limiting member is located as near to an upper end of a lower antenna portion as possible to block advancement of leakage current within a short distance to minimize a possible loss of the antenna.

In order to attain the objects, according to one aspect of the present invention, there is provided a telescoping antenna apparatus, which comprises a lower antenna portion, an upper antenna portion arranged coaxially with the lower antenna portion which is capable of retaining the upper antenna portion therein, a limiter for leakage current provided between the upper and lower antenna portions, the lower antenna portion being formed from a cylindrical conductor having an inner cavity for accommodating the upper antenna portion therein, and a coaxial feeder cable having an inner conductor and an outer conductor arranged coaxially with the inner conductor and extending through the inner cavity of the lower antenna portion, the upper antenna portion being connected with the coaxial feeder cable, the limiter for leakage current being provided in the inner cavity of the cylindrical conductor, the limiter for leakage current connecting the cylindrical conductor of the lower antenna portion with the outer conductor of the coaxial feeder cable so that the leakage current flowing from the upper and of the lower antenna portion into the coaxial feeder cable provided in the inner cavity of the lower antenna portion and the leakage current flowing between the outer conductor of the coaxial feeder cable and the upper antenna portion may be prevented.

The limiter for leakage current may include a cylindrical member for preventing leakage current disposed in the inside of the upper end of the lower antenna portion, and the limiter for leakage current may have a sleeve portion contacting in an electrically connected condition with an inner peripheral portion of the cylindrical conductor of the lower antenna, and a planar conductor provided at a lower end of the sleeve portion for electrically connecting the sleeve portion and the outer conductor of the coaxial feeder cable provided in the inner cavity.

Further, the lower antenna portion may be constructed to be capable of containing the upper antenna portion in the inner cavity thereof, and the sleeve portion of the cylindrical member for preventing leakage current is provided for sliding movement on an inner peripheral portion of the cylindrical conductor of the lower antenna portion.

Further, the lower antenna portion may have provided at the upper end thereof an opening portion which has a diameter smaller than the outside diameter of the sleeve portion such that the sleeve portion may contact with the opening portion to prevent the upper antenna portion from being projected and coming off from the lower antenna portion.

According to another aspect of the present invention, there is provided an antenna apparatus, which comprises a lower antenna portion, an upper antenna portion arranged coaxially above the lower antenna portion for relative axial movement such that the upper antenna portion may be contracted into or extended from the lower antenna portion and the upper and lower antenna portions may each act as an independent antenna, the lower antenna portion having an inner cavity for accommodating the upper antenna portion therein, a coaxial feeder cable extending through the inner cavity of the lower antenna portion and connected with the upper antenna portion, and a cylindrical member for preventing leakage current provided in the inner cavity of the lower antenna portion for preventing current from leaking from the upper antenna portion and the lower antenna portion, the cylindrical member for preventing leakage current having a sleeve portion contacting in an electrically connected condition with the inside of the lower antenna portion and a planar conductor provided at a lower end of the sleeve portion for electrically connecting the sleeve portion and the coaxial feeder cable with each other, the length of the sleeve portion being determined such that a substantially maximum impedance may be obtained at a boundary between the upper and lower antenna portions.

With the antenna apparatus of the present invention having such construction as described above, in order to allow the upper antenna portion to be contained in the lower antenna portion, the lower antenna portion has the inner cavity in which the upper antenna portion can be contained. In this instance, it may be a problem that high frequency current radiated from or received by the upper antenna portion leaks to an outer surface of the lower antenna portion or that radiation or reception current induced in an outer surface of the lower antenna portion leaks from an upper end of the lower antenna portion to the outer conductor of the coaxial feeder cable provided in the inside of the lower antenna portion. However, with the construction described above, since the outer conductor of the coaxial feeder cable in the inside of the lower antenna portion and an inner surface portion of the lower antenna portion are electrically short-circuited by way of the limiter for leakage current, a portion which is high in impedance to current which tends to flow from the upper antenna portion to the lower antenna portion, that is, current which tends to flow from the upper antenna portion along a surface of the outer conductor of the coaxial feeder cable below or inner and outer surfaces of the lower antenna portion below, can be formed at the upper end of the lower antenna portion. Meanwhile, leakage of high frequency current which tends to flow from the outer surface of the lower antenna portion to the outer conductor of the coaxial feeder cable can be prevented due to a phenomenon that current will not flow through the inside of the limiter for leakage current by the skin effect of high frequency current.

Consequently, even where the upper and lower antenna portions are disposed coaxially, they will not interfere with each other, and improvement in sensitivity of the antenna apparatus can be achieved.

Further, since the limiter for leakage current is placed in the inside of the lower antenna portion, it can be provided without increasing the overall height of the antenna apparatus, which is particularly high in effect with a telescoping antenna apparatus because the space for the accommodation thereof can be decreased.

Further, with the antenna apparatus constructed in such manner as described above, the cylindrical member for preventing leakage current is disposed in the inside of the upper end of the lower antenna portion which is formed from a cylindrical conductor having the inner cavity therein. Further, the cylindrical member for preventing leakage current is constituted from the sleeve portion contacting in an electrically connected condition with the inner periphery of the cylindrical conductor of the lower antenna portion and the planar conductor provided at the lower end of the sleeve portion for electrically connecting the coaxial feeder cable connected to the upper antenna portion and the sleeve portion with each other. The length of the sleeve portion is determined in advance such that the impedance thereof is so high at a boundary between the upper and lower antenna portions that leakage current may be limited sufficiently. Accordingly, not only leakage current flowing from the upper antenna portion to the outer conductor of the coaxial feeder cable but also leakage current flowing from the upper end of the lower antenna portion to the coaxial feeder cable located in the inner cavity of the lower antenna portion can be prevented by the cylindrical member for preventing leakage current.

BRIEF DESCRIPTION OF THE DRAWINGS

FIG. 4(*b*) is an explanatory view illustrating a leakage current cutting off characteristic of the antenna shown in FIG. 4(*a*).

PREFERRED EMBODIMENTS OF THE INVENTION

In the following, an embodiment wherein an antenna apparatus of the present invention is applied to a diversity antenna which is driven to be telescoped by a motor will be described with reference to the drawings.

Figure 1A:
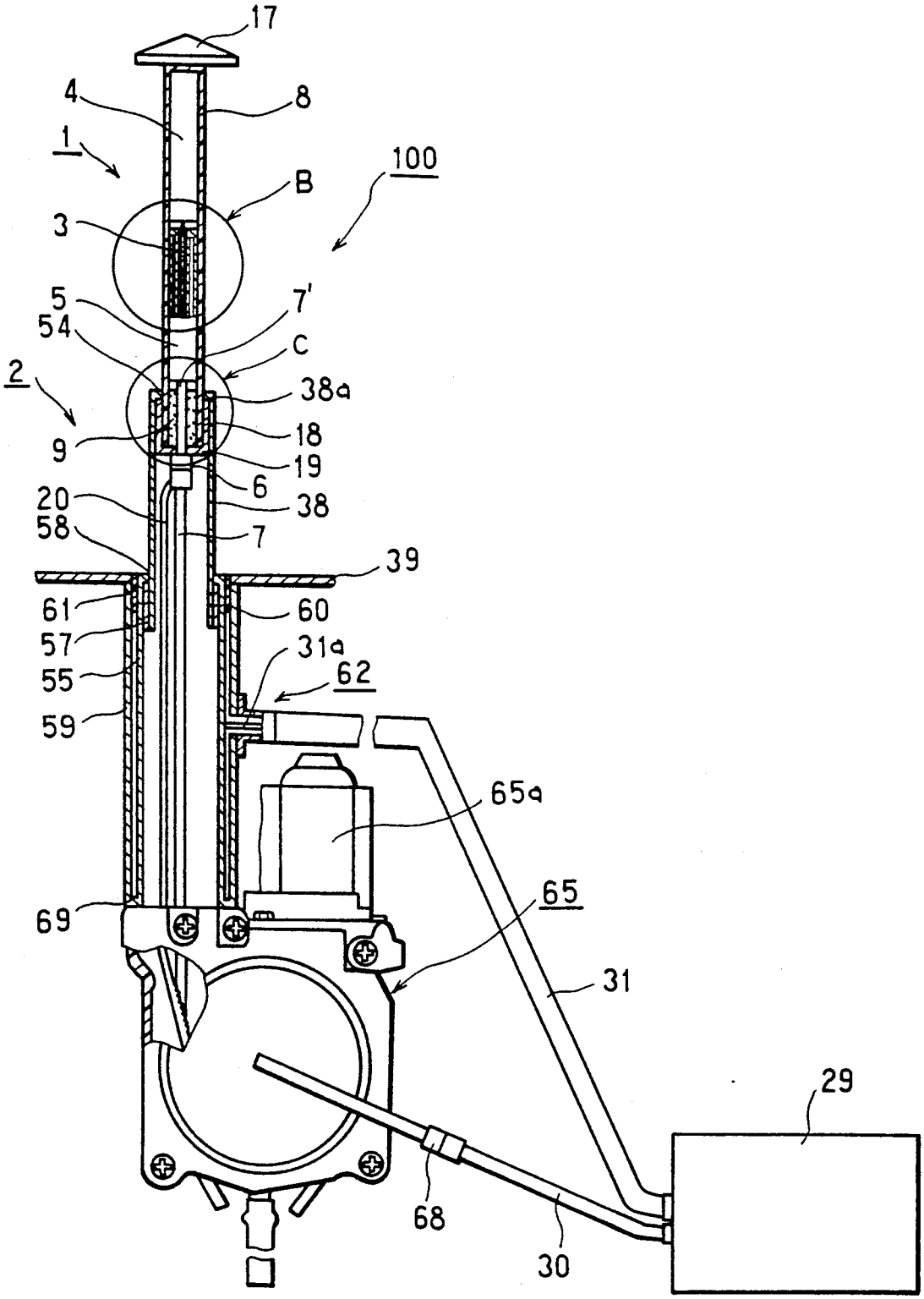
FIGS. 1(*a*), 1(*b*) and 1(*c*) are constructional views showing construction of an embodiment wherein the present invention is applied to a diversity antenna.
Figure 1B:
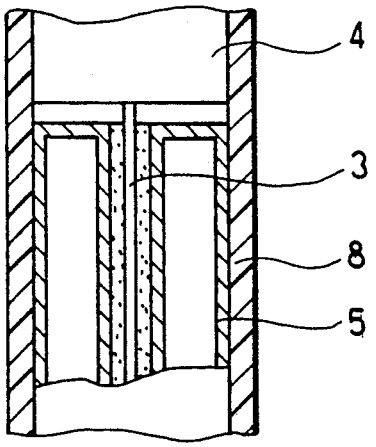
Figure 1C:
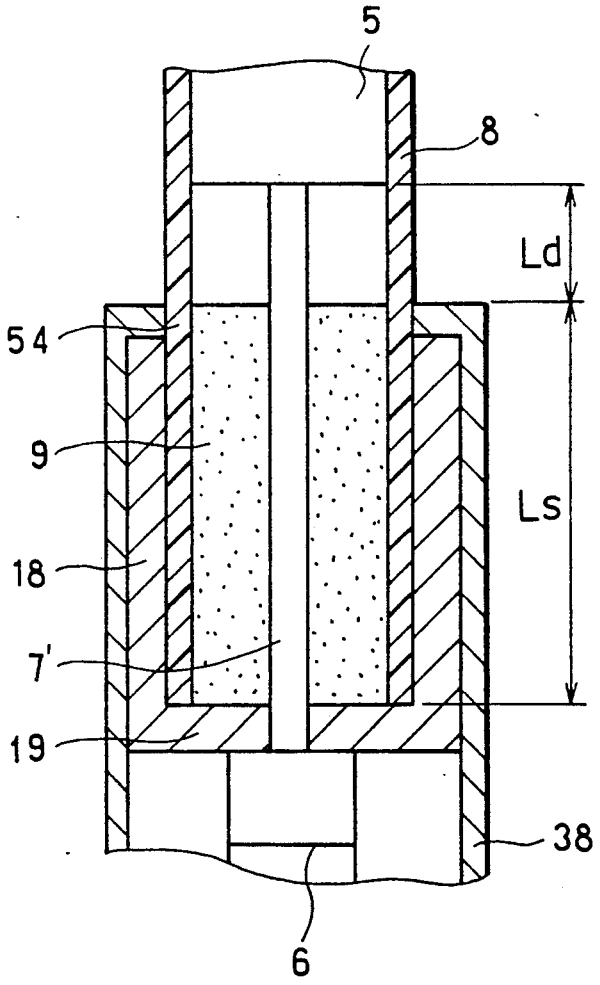

FIG. 1(*a*) is a partial sectional view showing entire construction of a diversity antenna for a vehicle: FIG. (*b*) is an enlarged view of a portion B shown in FIG. 1(*a*): and FIG. 1(*c*) is an enlarged view of another portion C shown in FIG. 1(*a*).

Referring to FIG. 1(*a*), reference numeral 1 denotes a sleeve antenna serving as an upper antenna portion, and 2 a monopole antenna serving as a lower antenna portion, and a diversity antenna 100 is constituted from the antennae 1 and 2. The antennas 1 and 2 are used for the transmission and reception of a car telephone, and while only the upper antenna portion 1 is used upon transmission, both of the upper and lower antenna portions 1 and 2 are used upon reception. Thus, a radio-frequency receiver is changed over to one of the upper and lower antenna portions which is higher in reception sensitivity so as to use them as a diversity antenna.

Reference numeral 3 denotes a coaxial feeder cable inner conductor of the sleeve antenna 1, 4 radiation portion of the sleeve antenna 1, and 5 $\lambda/4$ gap of the sleeve antenna 1, and a $\lambda/2$ dipole type antenna is formed by the radiation portion 4 and $\lambda/4$ gap 5. It is to be noted that, in the present invention, $\lambda$ denotes a wavelength of a center frequency of a communication frequency band. Meanwhile, reference numeral 6 in FIG. 1(*a*) denotes a connecting portion between upper and lower coaxial feeder cables 7 and 7', and 8 a radome of the sleeve antenna 1 made of a resin.

Reference numeral 38 denotes a cylindrical conductor of the monopole antenna 2, and the length of the monopole antenna 2 is determined to be $\lambda/4$ or $5\lambda/8$ so as to form an antenna of the dipole type of $\lambda/2$ or $5\lambda/4$ with respect to a grounding face provided by a metal portion of a body 39 of an automobile depending upon a principle of a mirror image.

The radome 8 is inserted at a portion thereof in the cylindrical conductor 38, and a sleeve portion 18 made of a conductor is fixedly mounted on an outer periphery of the inserted portion of the radome 8. The outside diameter of the sleeve portion 18 is set a little smaller than the inside diameter of the cylindrical conductor 38 such that an outer peripheral face of the sleeve portion 18 can be slidably moved smoothly in an electrically connected condition on an inner peripheral face of the cylindrical conductor 38. A planar conductor 19 is securely mounted on a lower end face of the sleeve portion 18, and the upper coaxial feeder cable 7' extends through a central portion of the planar conductor 19. The sleeve portion 18 and the outer conductor of the coaxial feeder cable 7' are electrically connected to each other by way of the planar conductor 19. Meanwhile, an opening portion 54 having a diameter a little greater than the outside diameter of the radome 8 but smaller than the outside diameter of the sleeve portion 18 is formed at an upper end face 38*a* of the cylindrical conductor 38 of the lower antenna portion 2.

Thus, a coaxial cylindrical member for preventing leakage current is constituted from the planar conductor 19 and the sleeve portion 18 described above. An insulating material 9 having a predetermined dielectric constant $\epsilon_r$ is filled in the inside of the radome 8 securely mounted in the sleeve portion 18 of the cylindrical member for preventing leakage current.

Meanwhile, the cylindrical conductor 38 constituting the monopole antenna 2 is inserted at a portion thereof in an accommodating pipe 55 constituting an inner cylindrical pipe of an accommodating section, and a sleeve 57 of a conductor is securely mounted on an outer periphery of the thus inserted portion of the cylindrical conductor 38. The outside diameter of the sleeve 57 is set a little smaller than the inside diameter of the accommodating pipe 55 such that the sleeve 57 may be slidably moved smoothly in the inside of the accommodating pipe 55. The accommodating pipe 55 has an opening portion 58 at an upper end face thereof, and the diameter of the opening portion 58 is set a little greater than the outside diameter of the cylindrical conductor 38 but smaller than the outside diameter of the sleeve 57. Accordingly, the cylindrical conductor 38 is prevented from being projected and coming off from the accommodating pipe 55 by the sleeve 57 securely mounted on the cylindrical conductor 38.

An antenna top member 17 made of a resin or a metal is provided at an upper end of the radome 8, and since the outside diameter of the antenna top member 17 is set greater than the diameter of the opening portion of the accommodating pipe 55, when the antenna apparatus is in an accommodated condition, the antenna top member 17 contacts with the opening portion 58 of the accommodating pipe 55 so that the radome 8 is not advanced into the accommodating pipe 55 any more.

Reference numeral 59 denotes an outer sleeve which coaxially surrounds the accommodating pipe 55 to constitute the accommodating section. The outer sleeve 59 is short-circuited at a short-circuiting portion 69 and electrically connected to the accommodating pipe 55 by way of the short-circuiting portion 69. Further, the outer sleeve 59 is connected and grounded at an upper end thereof to the automobile body 39. A ring 60 made of a resin is inserted in a gap between the outer sleeve 59 and the accommodating pipe 55. It is to be noted that reference numeral 61 denotes an insertion mounting hole for the outer sleeve 59, and the insertion mounting hole 61 is formed in the automobile body 39.

Reference numeral 62 denotes a coaxial connector, which is used as an output terminal of a lower feeder cable 31 for supplying power from a communication device 29 to the monopole antenna 2. An inner conductor 31*a* of the lower feeder cable 31 extends through a through-hole formed in the outer sleeve 59 and is connected to the accommodating pipe 55.

Reference numeral 68 denotes an output terminal of the sleeve antenna 1, and the output terminal 68 is connected to an upper feeder cable 30 which supplies power from the communication device 29.

A rack cable 20 is disposed in parallel to the coaxial feeder cable 7 connected to the sleeve antenna 1 and extends through the insides of the cylindrical conductor 38 of the monopole antenna 2 and the accommodating pipe 55. The rack cable 20 is drawn in or drawn out by a known driving section 65 including a motor so that the sleeve antenna 1 and monopole antenna 2 are accommodated into or extended from the accommodating pipe 55. It is to be noted that, since the driving section 65 has basically similar driving structure to that of a known driving section for a motor antenna disclosed in U.S. Pat. No. 4,864,322, detailed description thereof is omitted herein.

Subsequently, operation of the antenna apparatus of the present embodiment having such construction as described above will be described with reference to FIGS. 2(*a*), 2(*b*), 2(*c*) and 3.

Figure 2A:
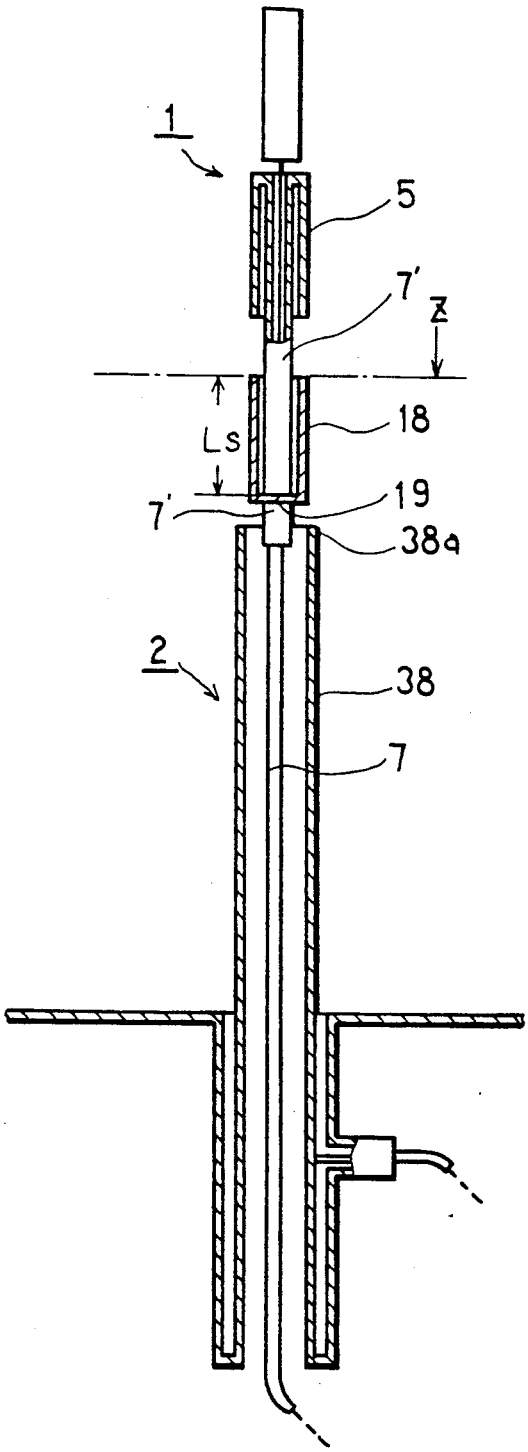
FIGS. 2(*a*), 2(*b*) and 2(*c*) are schematic views schematically showing construction of an antenna corresponding to presence and absence and a location of a cylindrical member for preventing leakage current.
Figure 2B:
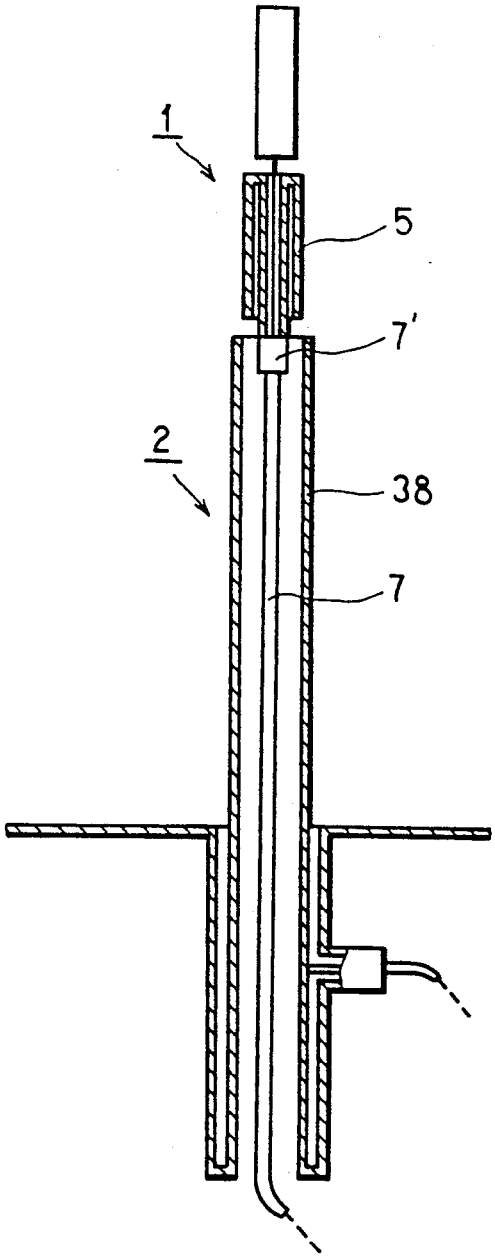
Figure 2:
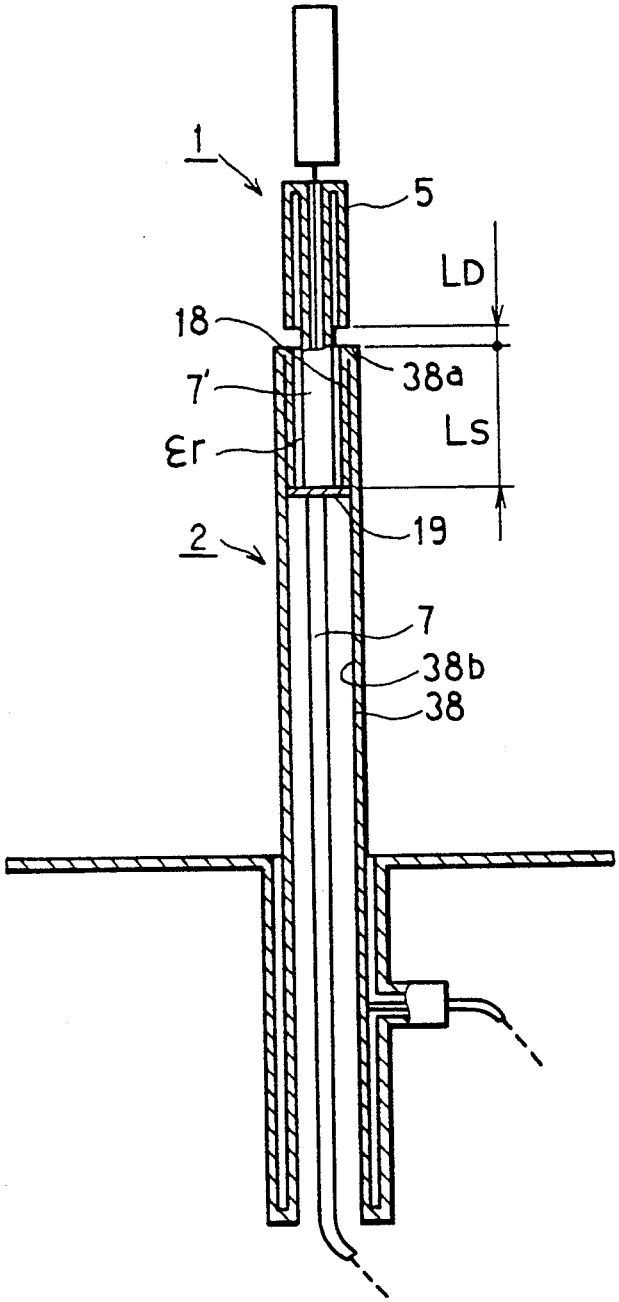

First, a characteristic of an antenna apparatus wherein the cylindrical member for preventing leakage current is mounted between the upper and lower antenna portions as shown in FIG. 2(*a*) will be described. It is to be noted that FIG. 2(*a*) and FIG. 2(*b*) do not show a prior art antenna apparatus but show a comparative example to facilitate understanding of the present invention.

The cylindrical member for preventing leakage current constituted from the sleeve portion 18 and the planar conductor 19 is provided so that leakage current of the upper antenna portion 1 may not have an influence on an impedance characteristic of the lower antenna portion 2. In particular, the sleeve portion 18 is provided in a coaxial condition with the upper coaxial feeder cable 7', and the planar conductor 19 for electrically connecting the outer conductor of the upper coaxial feeder cable 7' and the sleeve portion 18 to each other is provided at the lower end of the sleeve portion 18. Then, the length $L_s$ of the sleeve portion 18 or the positional relationship between the gap 5 of the upper antenna portion 1 and the sleeve portion 18 is determined such that the impedance Z between the upper coaxial feeder cable 7' and the sleeve portion 18 may be maximum at the upper end of the sleeve portion 18, and consequently, leakage current flowing from the upper antenna portion 1 toward the outer conductor of the coaxial feeder cable 7 can be cut off.

However, if radiation electric and magnetic fields in the arrangement of FIG. 2(*a*) are considered, then electric current is induced also in the cylindrical member 18 and 19 for preventing leakage current. Also, electric current is induced in a portion of the coaxial feeder cable 7' for the upper antenna portion 1 below the sleeve portion 18 of the cylindrical member for preventing leakage current. Then, the current phases of the induced currents are such phases as will have an influence on the original impedance characteristics of the upper and lower antenna portions 1 and 2. Meanwhile, current induced in the lower antenna portion 2, or more accurately, high frequency current induced in an outer surface of the cylindrical conductor 38 of the lower antenna portion 2, leaks from the upper end 38*a* of the cylindrical conductor 38 to the outer conductor of the lower coaxial feeder cable 7 and thus serves as current which does not contribute to radiation at all, and consequently, such high frequency current will make a loss.

As described above, in the arrangement of FIG. 2(*a*), current induced in the sleeve portion 18 and current induced in the outer conductor of the upper coaxial feeder cable 7' below the sleeve portion 18 will have an influence on an impedance characteristic of the lower antenna portion 2. Meanwhile, current induced in the cylindrical conductor 38 of the lower antenna portion 2 leaks from the upper end 38*a* of the cylindrical conductor 38 to the outer conductor of the lower coaxial feeder cable 7 as a factor which deteriorates the sensitivities of the upper and lower antenna portions 1 and 2. Further, the overall length of the antenna apparatus is increased by a distance equal to the length of the cylindrical member for preventing leakage current, and consequently, the length of the accommodating pipe (the portion corresponding to the reference character 55 of FIG. 1(*a*)) or the like must be increased, which will provide a limitation in mounting the antenna apparatus on a vehicle.

Meanwhile, in case no cylindrical member for preventing leakage current is provided as shown as a comparative example in FIG. 2(*b*), the length of the antenna accommodating pipe can be reduced, but on the other hand, mutual interference between the upper and lower antenna portions cannot be eliminated sufficiently, and consequently, the reception sensitivity is deteriorated. In particular, even if the relative positions of the upper and lower antenna portions 1 and 2 are determined such that the current distribution of the coaxial feeder cables 7 and 7' may be minimum at a boundary between the upper and lower cable portions 1 and 2, it is difficult to cut off leakage current over a wide band.

FIG. 2(*c*) schematically shows construction of the diversity antenna apparatus of the embodiment of the present invention described above. In the diversity antenna apparatus, since the cylindrical member 18 and 19 for preventing leakage current is provided such that it surrounds the upper end of the inside of the lower antenna portion 2, leakage current flowing from the upper antenna portion 1 toward the outer conductor of the coaxial feeder cable 7 can be cut off, and consequently, no bad influence will be had on an impedance characteristic of the lower antenna portion 2. It is also possible to cut off high frequency current induced in an outer surface of the cylindrical conductor of the lower antenna portion 2 to leak from the upper end 38*a* of the cylindrical conductor 38 to a surface of the outer conductor of the lower coaxial feeder cable 7 or to an inner surface 38*b* of the cylindrical conductor 38. In short, such high frequency current flows only along the surface due to the skin effect and consequently is limited by the planar conductor 19. Further, since the length of the antenna apparatus can be reduced by a distance equal to the length of the cylindrical member for preventing leakage current as compared with that of the arrangement of FIG. 2(*a*), the limitation when the antenna apparatus is mounted on a vehicle can be reduced. In other words, in the arrangement shown in FIG. 2(*c*), since the cylindrical member 18 and 19 for preventing leakage current is located in the inside of the lower antenna portion 2 and the outer conductor of the coaxial feeder cable 7 for the upper antenna portion 1 and the surfaces of the lower and upper antenna portions 2 and 1 are isolated from each other, even if current leaks between the upper and lower antenna portions 1 and 2, various dimensions of the entire antenna apparatus can be adjusted so that such leakage current may contribute to radiation electric and magnetic fields.

Figure 3:
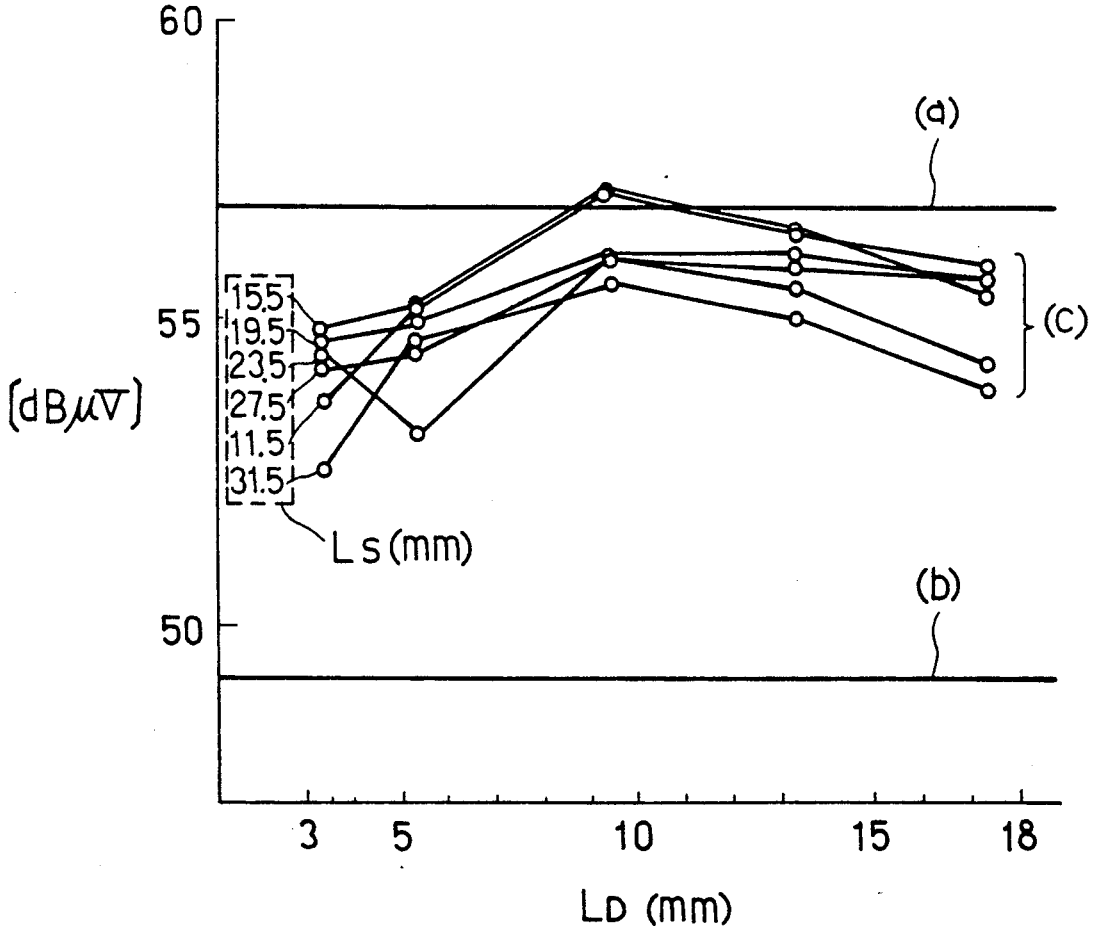
FIG. 3 is a characteristic view illustrating reception sensitivities of the antenna shown in FIGS. 2(*a*), 2(*b*) and 2(*c*), respectively.

FIG. 3 shows sensitivities of the individual antenna apparatus shown in FIGS. 2(*a*), 2(*b*) and 2(*c*). Particularly with regard to the antenna apparatus shown in FIG. 2(*c*), it is shown how the average reception sensitivity in a horizontal plane of the lower antenna portion 2 varies when the distance $L_d$ from a lowermost end of the $\lambda/4$ Sperrtopf 5 of the upper antenna portion 1 to the upper end of the lower antenna portion 2 is varied with respect to various values of the length $L_5$ of the sleeve portion 18 ranging from 15.5 to 31.5 mm. In this instance, however, the reception frequency of each antenna is 872.5 MHz.

It can be seen that a highest reception sensitivity can be obtained where the length $L_S$ of the sleeve portion 18 is 11.5 mm to 13.5 mm and the distance $L_D$ from the lower end of the $\lambda/4$ Sperrtopf 5 to the upper end of the lower antenna portion 2 is 10 mm as shown in FIG. 3. It is to be noted that, with the antenna apparatus which has been used to produce the graphs of FIG. 3, an insulating resin (ABS resin) serving as an insulating material is filled in the inside of the radome 8 on which the sleeve portion 18 is securely mounted. Where an insulating resin is filled in this manner, the length $L_S$ of the sleeve portion 18 can be reduced by a distance equal to a square root of a dielectric constant of the insulating resin, and consequently, also the length of the accommodating pipe for the antenna apparatus can be further reduced and the limitation in mounting the antenna apparatus on a vehicle can be further reduced. It is to be noted that actually the antenna apparatus having such construction as shown in FIG. 2(*c*) can be reduced in overall length by about 30 mm to 80 mm comparing with the antenna apparatus having such construction as shown in FIG. 2(*a*).

Subsequently, description will be given of how to make the impedance Z between the upper coaxial feeder cable 7' and the sleeve portion 18 maximum with the construction of FIG. 2(*c*).

First, the length $L_S$ of the sleeve portion 18 is determined in accordance with the following expression:

$$L_S = L_{S\phi}(1/\epsilon_r)^{\frac{1}{2}}$$

$$L_{S\phi} = \{(\tfrac{1}{2})n + (\tfrac{1}{4})\}\lambda$$

where n=0, 1, 2, . . . , and $\epsilon_r$ is a dielectric constant of the insulating material 9.

Then, the value of the length of the sleeve portion 18 is varied around the length $L_S$ determined in accordance with the expression given above to determine an optimum length. In this instance, while there is means for directly measuring a current distribution, the optimum length may be determined indirectly while observing the antenna sensitivity.

Where the optimum length $L_S$ determined in this manner is adopted, when the inside of the cylindrical conductor 38 is seen at the upper end face 38*a* of the cylindrical conductor 38, the impedance is maximum, and the leakage of current is reduced.

However, it is difficult to completely eliminate leakage, and it is preferable to take a dimension $L_D$ (FIG. 2(*c*)) indicative of the positional relationship between the upper and lower antenna portions 1 and 2 into consideration and vary the sensitivity as shown in FIG. 3 with a combination of values of $L_S$ and $L_D$ to obtain an optimum structure. It is to be noted that, since it is only necessary for an antenna apparatus to have a current distribution which is greatest in magnitude at a feeding point whether or not there is leakage of current, it is also possible to displace the impedance Z from its maximum point to increase leakage current flowing from the upper antenna portion to the lower antenna portion a little to determine a combination of values ($L_S$ and $L_D$) which utilize the leakage current effectively as radiation current so as to optimize the final result of the antenna sensitivity. In this instance, in order to utilize all of the leakage current as antenna radiation current, the leakage current must not be leaked to the coaxial feeder cable 7 in the cylindrical conductor 38. Such leakage, however, can be prevented with the construction of FIG. 2(*c*) in accordance with the present invention.

While the embodiment of the present invention described above is described as a diversity antenna apparatus wherein the upper and lower antenna portions are constituted from a sleeve antenna and a monopole antenna, respectively, the present invention is not limited to the embodiment described above, and any antenna may be employed only if a diversity antenna can be constructed.

Further, the present invention is not limited to a diversity antenna apparatus, and similar effects can be obtained even where the present invention is applied to a shared antenna apparatus wherein a plurality of antenna portions are disposed at upper and lower stages so that radio waves of different frequency bands may be transmitted or received.

Further, while an antenna apparatus for a vehicle according to the present invention is constructed as a motor antenna in the embodiment described above, it may otherwise be constructed as an antenna apparatus of a so-called pull top type wherein an antenna element is drawn out by hand. Further, it may otherwise be constructed as an antenna apparatus wherein individual antenna elements are fixed and cannot be telescoped. In this instance, since the sleeve portion 18 need not be constructed as a stopper for the upper antenna element 1 as in the embodiment of FIG. 1(*a*), it is also possible to provide the sleeve portion 18 at some location other than the upper end of the lower antenna portion 2.

Figure 4A:
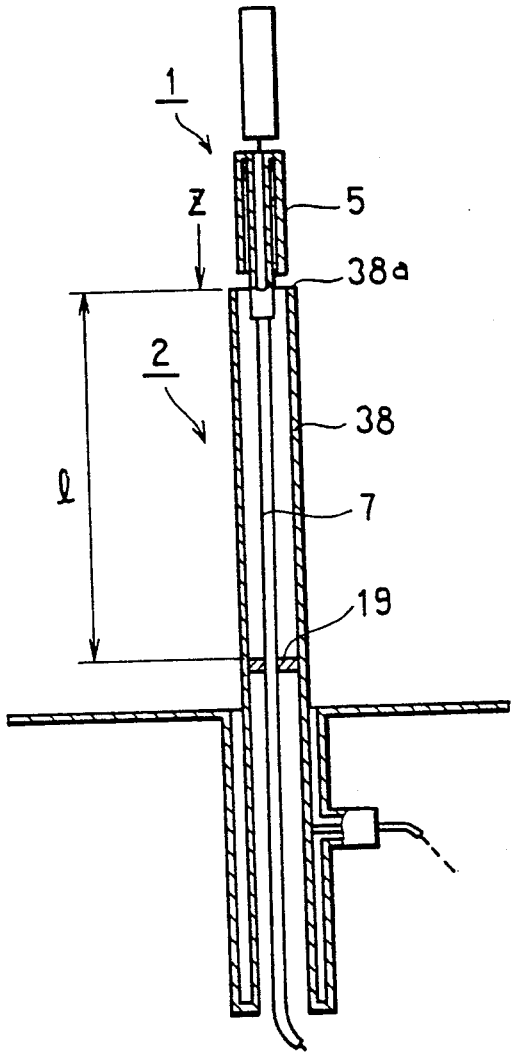
FIG. 4(*a*) is a schematic view schematically showing construction of another embodiment of the present invention.
Figure 4B:
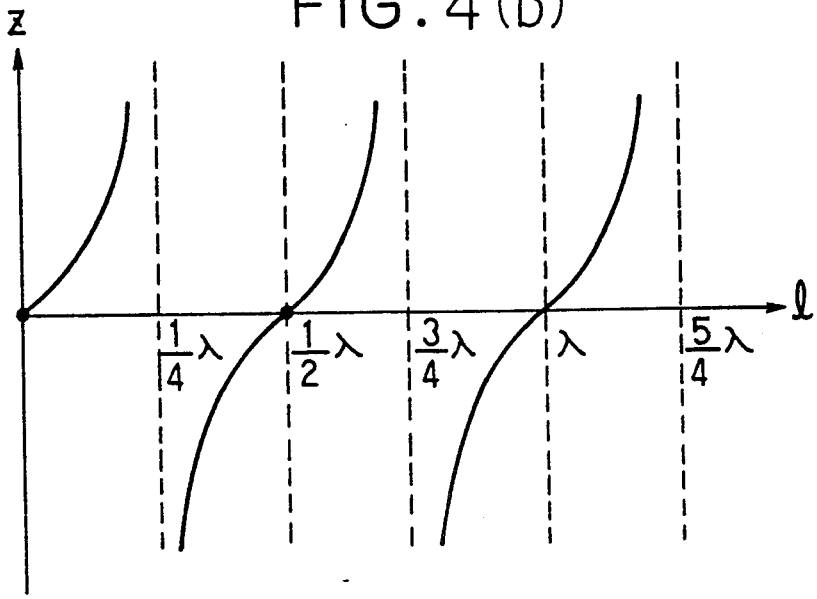

Subsequently, a second embodiment will be described with reference to FIGS. 4(*a*) and 4(*b*). In the second embodiment, the limiter for leakage current is formed not as a cylindrical limiter but as a planar limiter. As shown in FIG. 4(*a*), a disk 19 formed from a conductor is provided at a predetermined position in the inside of the cylindrical conductor 38 of the lower antenna portion 2 such that the outer conductor of the coaxial feeder cable 7 and an inner peripheral portion of the cylindrical conductor 38 are electrically connected to each other.

It is to be noted that, in FIG. 4(*a*), the cylindrical conductor 38 constitutes a coaxial line wherein an outer surface portion of the outer conductor of the coaxial feeder cable 7 serves as a center conductor. Further, the disk 9 constitutes a short-circuiting plate for short-circuiting the coaxial line, that is, the inner peripheral portion of the cylindrical conductor 38 and the outer surface portion of the outer conductor of the coaxial feeder cable 7. Then, where the impedance of the coaxial line is represented by $Z_\phi$ and the length of the coaxial line is represented by l and then the impedance when the inside of the cylindrical conductor 38 is seen at the upper end face 38*a* of the cylindrical conductor 38 is represented by Z.

$$Z = j\,Z_{100} \tan \beta l$$

where $\beta = 2\pi/\lambda$, and $\lambda$ is a wavelength. To increase the impedance Z when the inside of the cylindrical conductor 38 is seen at the upper end face 38*a* is to decrease the influence of leakage current between the upper and lower antenna portions. The relationship between the impedance Z and the coaxial line length l is shown in FIG. 4(*b*). Then, requirements to assure a high impedance Z are:

$$\beta l = (\pi/2) + n\pi$$

$$l = \{(\tfrac{1}{2})n + (\tfrac{1}{4})\}\lambda (n = 0, 1, 2, \ldots)$$

In short, the position at which the impedance Z is high is: $l = (\frac{1}{4})\lambda$ when n=0; $l = (\frac{3}{4})\lambda$ when n=1; and $l = (5/4)\lambda$ when n=2. If the disk 19 is provided at such position, then the impedance Z at the upper end of the cylindrical conductor 38 can be made maximum as shown in FIG. 4(*b*), and leakage current between the upper and lower antenna portions 1 and 2 can be cut off similarly as in the preceding embodiment described hereinabove.

FIG. 4(*b*) shows a variation of the impedance Z when the distance l is varied. It is apparent that the impedance presents a maximum value at $l = (\frac{1}{4})\lambda$, $(\frac{3}{4})\lambda$, $(5/4)\lambda$, . . .

As described so far, according to the embodiment described above, in an antenna apparatus for a vehicle wherein a plurality of antenna portions which individually act as different antennae are disposed coaxially, leakage current flowing from the upper end of the lower antenna portion to the coaxial feeder cable connected to the upper antenna portion can be cut off by the cylindrical member for preventing leakage current, and accordingly, the impedance characteristic of the lower antenna portion will not be varied, and consequently, the sensitivity will not be deteriorated. Consequently, the reception sensitivity of the antenna apparatus for a vehicle can be improved.

Further, since the cylindrical member for preventing leakage current is disposed in the inside of the lower antenna portion, the length of the accommodating section for accommodating the antenna apparatus therein need not be increased and the antenna apparatus can be mounted readily on a vehicle. Further, according to the latter embodiment, since the cylindrical member for preventing leakage current is constituted from a disk which is disposed at a predetermined position in the inner cavity of the cylindrical conductor of the lower antenna portion to increase the impedance of the upper end of the cylindrical conductor, a possible bad influence upon the lower antenna portion can be prevented.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What is claimed is:

1. A telescoping antenna for a vehicle comprising:
a lower antenna portion including a cylindrical conductor which has an inner cavity;
an upper antenna portion coaxially arranged with said lower antenna portion so as to be inserted in said inner cavity and to protrude from said inner cavity;
a coaxial feeder cable provided in said inner cavity and electrically connected to said upper antenna portion; and
leakage current preventing means, provided in said inner cavity, for preventing first leakage current from flowing into said coaxial feeder cable from said upper antenna portion, and for preventing second leakage current from flowing into said coaxial feeder cable from said cylindrical conductor.

2. A telescoping antenna according to claim 1, wherein said leakage current preventing means includes short-circuit means for electrically connecting said coaxial feeder cable to said cylindrical conductor so that an impedance between said upper antenna portion and said lower antenna portion is effectively increased.

3. A telescoping antenna according to claim 2, wherein said short-circuit means includes a cylindrical member having a predetermined length such that maximum impedance is obtained between said upper antenna portion and said lower antenna portion.

4. A telescoping antenna according to claim 3, wherein said cylindrical member comprises:
a sleeve portion having said predetermined length and being movable into electrical and mechanical contact with said cylindrical conductor; and
a planar conductor integrally coupled to one end of said sleeve portion and electrically connected to said coaxial feeder cable.

5. A telescoping antenna according to claim 2, wherein said short-circuit means includes a planar conductor coupled to said cylindrical conductor and being in electrical contact with said coaxial feeder cable at a predetermined position which is determined by a length from an upper end of said cylindrical conductor, such that maximum impedance is obtained between said upper antenna portion and said lower antenna portion.

6. A telescoping antenna for a vehicle comprising:
a lower antenna portion including a cylindrical conductor which has an inner cavity;
an upper antenna portion coaxially arranged with said lower antenna portion so as to be inserted in said inner cavity and to protrude from said inner cavity;
a coaxial feeder cable provided in said inner cavity and electrically connected to said upper antenna portion; and
leakage current preventing means, provided in said inner cavity, for preventing first leakage current from flowing into said coaxial feeder cable from said upper antenna portion, and for preventing second leakage current from flowing into said coaxial feeder cable from said cylindrical conductor, wherein said leakage current preventing means includes short-circuit means for electrically connecting said coaxial feeder cable to said cylindrical conductor so that an impedance between said upper antenna portion and said lower antenna portion is effectively increased, said short-circuit means including a cylindrical member having a predetermined length such that maximum impedance is obtained between said upper antenna portion and said lower antenna portion, wherein said cylindrical member comprises:
a sleeve portion having said predetermined length and being movable into electrical and mechanical contact with said cylindrical conductor;
a planar conductor integrally coupled to one end of said sleeve portion and electrically connected to said coaxial feeder cable; and
an insulating material filled in an inner space formed by said sleeve portion and said planar conductor.

7. A telescoping antenna for a vehicle comprising:
a lower antenna portion including a cylindrical conductor which has an inner cavity;
an upper antenna portion coaxially arranged with said lower antenna portion so as to be inserted in said inner cavity and to protrude from said inner cavity;
a coaxial feeder cable provided in said inner cavity and electrically connected to said upper antenna portion; and
cylindrical member means, provided in said inner cavity and coupled to a lower end of said upper antenna portion so as to be moveable together with said upper antenna portion, for electrically connecting said coaxial feeder cable to said cylindrical conductor so that first leakage current is prevented from flowing into said coaxial feeder cable from said upper antenna portion and that second leakage current is prevented from flowing into said coaxial feeder cable from said cylindrical conductor.

8. A telescoping antenna according to claim 7, wherein said cylindrical member means has a predetermined length such that maximum impedance is obtained between said upper antenna portion and said lower antenna portion.

9. A telescoping antenna according to claim 7, wherein said lower antenna portion includes a stopper means, formed on an upper end of said lower antenna portion, for stopping said cylindrical member means when said upper antenna portion is fully protruded.

10. A telescoping antenna according to claim 7, wherein said lower antenna portion is mounted on a vehicle body.

11. A telescoping antenna for a vehicle comprising:

a lower antenna portion including a cylindrical conductor which has an inner cavity;

an upper antenna portion coaxially arranged with said lower antenna portion so as to be inserted in said inner cavity and to protrude from said inner cavity;

a coaxial feeder cable provided in said inner cavity and electrically connected to said upper antenna portion; and cylindrical member means, provided in said inner cavity and coupled to a lower end of said upper antenna portion so as to be moveable together with said upper antenna portion, for electrically connecting said coaxial feeder cable to said cylindrical conductor so that first leakage current is prevented from flowing into said coaxial feeder cable from said upper antenna portion and that second leakage current is prevented from flowing into said coaxial feeder cable from said cylindrical conductor, wherein said cylindrical member means comprises:

a sleeve portion having said predetermined length and being movable into electrical and mechanical contact with said cylindrical conductor;

a planar conductor integrally coupled to one end of said sleeve portion and electrically connected to said coaxial feeder cable; and an insulating material filled in an inner space formed by said sleeve portion and said planar conductor.

* * * * *